United States Patent [19]

Herron

[11] Patent Number: 4,696,606

[45] Date of Patent: Sep. 29, 1987

[54] METHOD OF STABILIZING A ROCK STRUCTURE

[75] Inventor: Lorne R. Herron, Beaconsfield, Canada

[73] Assignee: Atlas Copco Aktiebolag, Nacka, Sweden

[21] Appl. No.: 874,627

[22] Filed: Jun. 16, 1986

[30] Foreign Application Priority Data

Jun. 17, 1985 [SE] Sweden ..... 8502981

[51] Int. Cl.[4] ..... E21D 20/00

[52] U.S. Cl. ..... 405/259; 29/421 R; 72/58; 411/19

[58] Field of Search ..... 405/259, 260; 29/421 R, 29/523; 411/61, 74, 33; 72/58, 59

[56] References Cited

U.S. PATENT DOCUMENTS

| | | | |
|---|---|---|---|
| 2,696,137 | 12/1954 | Thomas et al. | 405/259 X |
| 3,148,577 | 9/1964 | Parsons | 405/259 X |
| 3,280,608 | 10/1966 | Parilla | 72/58 |
| 3,349,567 | 10/1967 | Munn | 405/259 |
| 3,897,619 | 8/1975 | Thivans | 29/421 |
| 3,922,867 | 12/1975 | Scott | 405/259 |
| 4,012,913 | 3/1977 | Scott | 405/259 |
| 4,098,087 | 7/1978 | Swain | 405/259 |
| 4,350,462 | 9/1982 | Elders | 405/259 |
| 4,459,067 | 7/1984 | Skogberg et al. | 405/259 |
| 4,511,289 | 4/1985 | Herron | 405/259 |
| 4,567,631 | 2/1986 | Kelly | 72/58 X |
| 4,577,386 | 3/1986 | Faudou et al. | 29/421 R X |
| 4,635,333 | 1/1987 | Finch | 72/58 X |

FOREIGN PATENT DOCUMENTS

| | | | |
|---|---|---|---|
| 1171310 | 7/1984 | Canada | 405/259 |

*Primary Examiner*—Dennis L. Taylor

*Attorney, Agent, or Firm*—Frishauf, Holtz, Goodman & Woodard

[57] ABSTRACT

A rock bolt in the form of a steel tube (11) is placed in a borehole in rock and is then expanded against the rock by means of an expandable body (15) inside it. The expandable body (15) comprises a rubber hose which is temporarily pressurized to a pressure that is usually 50–100 MPa so that the bolt anchors in the borehole. The expandable body (15) is part of a mounting tool and it is withdrawn immediately when depressurized.

18 Claims, 19 Drawing Figures

METHOD OF STABILIZING A ROCK STRUCTURE

BACKGROUND OF THE INVENTION

This invention relates to a method of stabilizing a rock structure comprising boring a hole, inserting in the borehole a tubular stabilizer that is slimmer than the borehole and expanding the tubular stabilizer to anchor in the borehole.

In U.S. Pat. No. 4,459,067, a rock stabilizer is shown which comprises a closed longitudinally folded tube which is pressurized to expand to anchor in the borehole. This bolt provides an outstanding anchoring and the accepted diameter range of the holes is extremely wide. However, the bolt is comparatively expensive.

In Canadian Pat. No. 1,171,310, a longitudinally folded rock stabilizer is shown which is expanded in the borehole by means of a mandrel that is forced into the stabilizer. The expansion of the stabilizer is comparatively complicated and requires a comparatively high force.

In U.S. Pat. No. 3,922,867 and 4,012,913 rock stabilizers are shown which comprise a tube with a longitudinal slot. The stabilizers are initially wider than the borehole and they are forced into the borehole. The insertion requires a force that is of the same magnitude as the anchoring, and the allowed diameter range for the holes is very narrow.

In U.S. Pat. No. 3,349,567, a rock stabilizer is shown which comprises a tube that is inserted in the borehole and then expanded at discrete points by pulsed magnetic fields induced by high voltage pulses in a coil in a probe that is temporarily inserted in the stabilizer. The anchoring will probably be poor.

It is an object of the invention to provide a method of stabilizing a rock structure that is fast and simple and makes a low total cost for stabilizers as anchored in the rock.

BRIEF DESCRIPTION OF THE DRAWINGS

The invention will be described with reference to the drawings in which.

DETAILED DESCRIPTION

Figure 1:
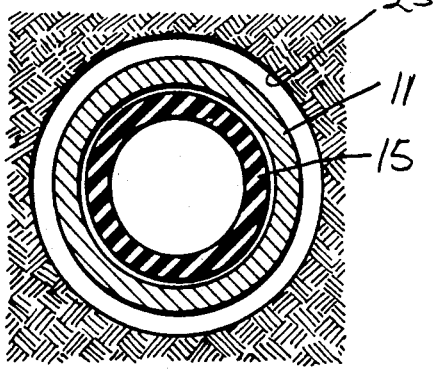
FIG. 1 is a transverse section along lines 1—1 in FIG. 4 through a borehole in the rock in which a stabilizer or rock bolt is inserted. Inside the stabilizer is an expandable body.

The rock stabilizer shown in FIGS. 1–7 comprises a tube 11 of metal for example steel and preferably mild steel. One of its ends is formed as a flange 12 that forms a support for a rock supporting plate 13.

An expansion body comprises an elastic tube 15 e.g. a hose of reinforced rubber that is part of a mounting tool 14 that is best shown in FIGS. 4–7.

Figure 2:
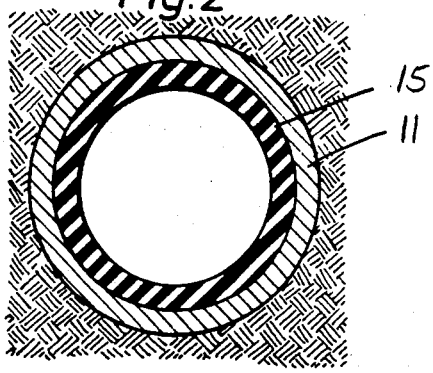
FIG. 2 is a section corresponding to FIG. 1 and taken along lines 2—2 in FIG. 5 but showing the stabilizer when being expanded to anchor in the borehole.
Figure 3:
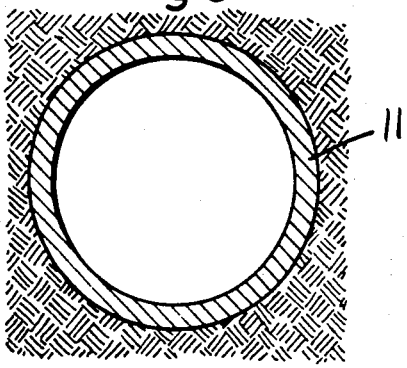
FIG. 3 is a section corresponding to FIGS. 1 and 2 and taken along lines 3—3 in FIG. 6 but showing the stabilizer anchored in the borehole and the expandable body removed.
Figure 4:
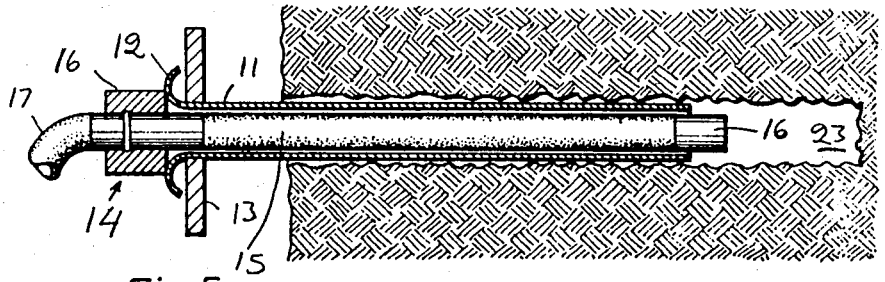
FIGS. 4–6 are longitudinal sections corresponding to FIGS. 1–3.
Figure 5:
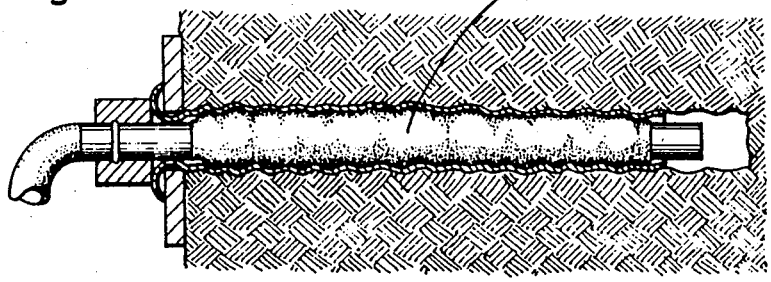
Figure 6:
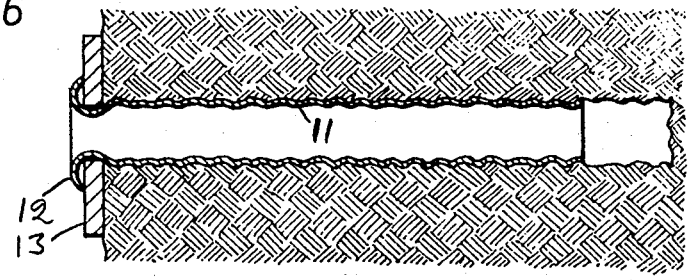
Figure 7:
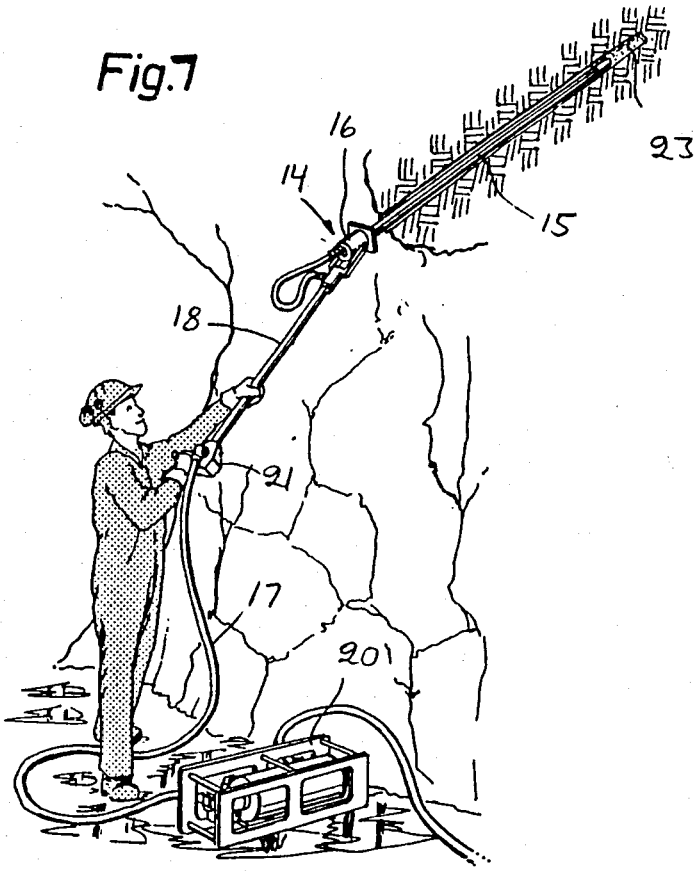
FIG. 7 is a view showing an operator mounting a stabilizer in a roof of a rock cavity, e.g. a tunnel.

The rubber hose 15, is mounted on a base 16 and its ends are sealed to the base 16. The base 16 is mounted on a rod 18 as can be seen in FIG. 7. Through a hose 17 which is coupled to a pump 20 through a supply valve 21 as shown in FIG. 7, the elastic tube 15 of the mounting tool 14 can be pressurized to expand radially. In FIG. 7 the mounting of a stabilizer 11 is shown. The mounting tool 14 is first inserted in the stabilizer 11 and used to insert the stabilizer in a borehole 23 as shown in FIGS. 7, 4, and 1. Then, the valve 21 is actuated to pressurize the elastic tube 15 to expand so that the tube 15 forces the stabilizer 11 against the borehole at such a force that the stabilizer is deformed plastically to expand against the borehole and to transmit a force to the borehole which widens the borehole by elastic deformation of the rock as shown in FIGS. 5, 7, and 2. Further, the stabilizer 11 is plastically deformed to adjust to the irregularities of the borehole as shown in an exaggerated manner in FIG. 5. Then, the elastic tube 15 of the mounting tool 14 is depressurized and the mounting tool 14 is removed, leaving the stabilizer 11 anchored in the borehole as shown in FIGS. 3 and 6. The elastically deformed rock shrinks more than the plastically deformed stabilizer 11 and there will be a shrinkage fit between the stabilizer and the borehole which anchors the bolt by friction. The plastic adjustment to the irregularities increases the anchoring. The stabilizer 11 can advantageously be made of mild steel and the hydraulic pressure can for example be 50–100 Mpa (500–1000 bar). It should be noted that a borehole wall is never smooth, and often the borehole is not completely straight but somewhat in spiral. It is also not very difficult to bore a hole that is less straight and has less smooth a surface than usual. The plastic adjustment of the stabilizer to the irregularities of the borehole increases the anchoring.

The stabilizer 11 can for example be 1–3 m long or longer and used in a borehole with a diameter of for example 25–45 mm. In all the figures but FIG. 7, the stabilizer 11 is shown shortened. The expansion body 15 of the mounting tool 14 can be about as long as the stabilizer 11 so that it can expand the entire length of the stabilizer as illustrated. It can also be shorter than the stabilizer and it can be used to expand a part of the stabilizer and then depressurized and moved in the stabilizer to expand another part of the stabilizer so that the entire stabilizer will eventually be expanded. Sometimes it might be desirable to expand only a part of the stabilizer 11 for example the part of the stabilizer adjacent the bottom of the borehole in order to get a top anchored bolt.

Figure 8:
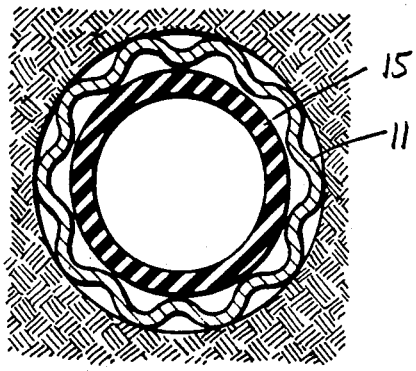
FIGS. 8–10 correspond to FIGS. 1–3 resp. but show a modified form of the stabilizer.
Figure 9:
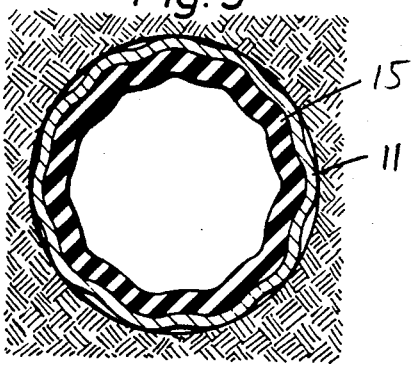
Figure 10:
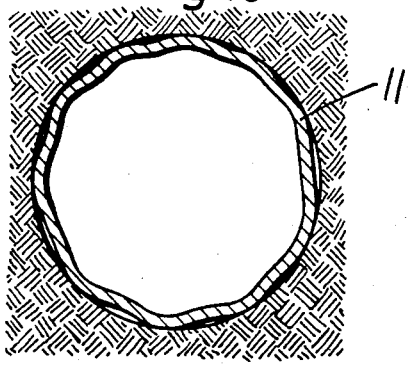

In FIGS. 8–10, which correspond to FIGS. 1–3, an alternative design of the stabilizer 11 is shown. The stabilizer comprises a corrugated steel tube 11. FIG. 8 shows the stabilizer before expansion, FIG. 9 shows the stabilizer during expansion and FIG. 10 shows the stabilizer anchored in the borehole.

Figure 11:
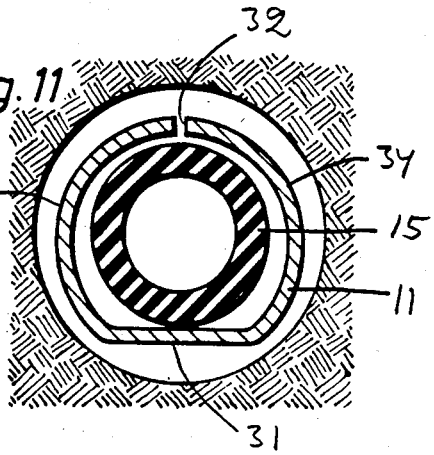
FIGS 11–13 correspond to FIGS. 1–3 resp. but show another modified form of the stabilizer.
Figure 12:
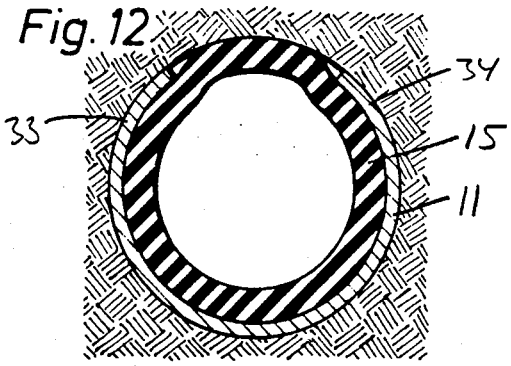
Figure 13:
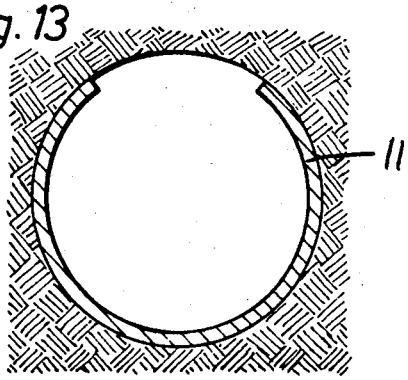
Figure 14:
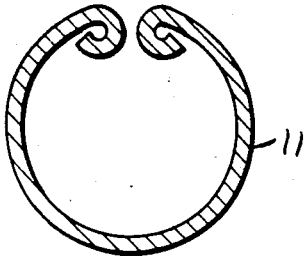
FIGS 14–17 show in cross-section four other forms of a stabilizer.

FIGS. 11–13 correspond also to FIGS. 1–3 too but they show another alternative design of the stabilizer 11. The tubular stabilizer 11 has a flat 31 and a slot 32 opposite the flat so that the two wings 33, 34 are formed. The flat 31 is forced against the borehole by the expandable hose 15 as shown in FIG. 12 and when the hose is depressurized, the area of the original flat 31 will act as a spring to force the wings 33, 34 outwardly and improve the anchoring by friction. There will probably be a clearance between the stabilizer 11 at the area of the original flat 31 and the rock when the stabilizer is anchored.

Figure 18:
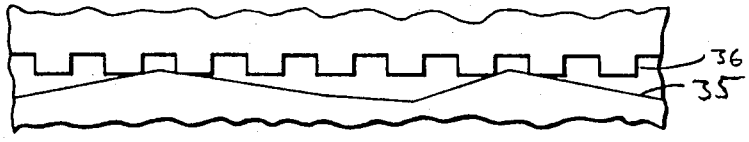
FIG. 18 is a fragmentary view seen as indicated by the arrows 18 in FIG. 15.
Figure 15:
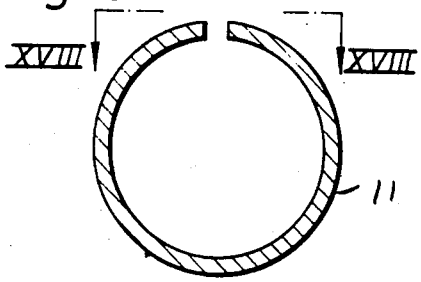

In FIGS. 14–17 modified cross section designs of slotted stabilizers 11 are shown. In FIG. 15, the tube 11 is circular in cross section. The slot may either be straight as in the embodiment shown in FIGS. 11–13 or it may be designed as shown in FIG. 18. One edge 35 is then ondulating and the other edge 36 is serrated. There will always be teeth of the serrated edge 36 that engage with the ondulating edge 35 to prevent shrinkage and thereby increase the anchoring force.

Figure 16:
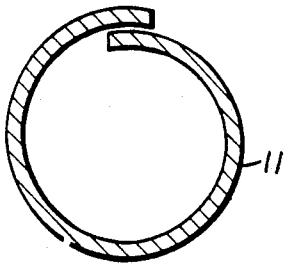
Figure 17:
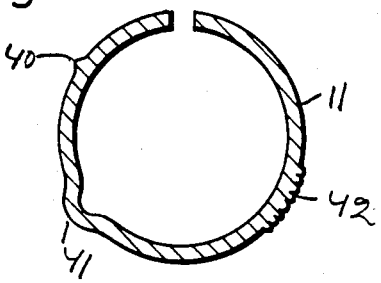

The tube 11 in FIG. 16 has overlapping longitudinal edges. The tube 11 in FIG. 14 has bent edges that contact each other. There may also be an open slot between the edges. In FIG. 17, three different ways of making the outer surface of the tube 11 rough are shown. The metal strip forming the tube 11 can have protruding weld spots 40; it can be punched to form knobs 41 or it can be knurled as shown at 42. By making the surface rough in any illustrated or non-illustrated way, the pull-out force of the stabilizer will usually be increased.

Figure 19:
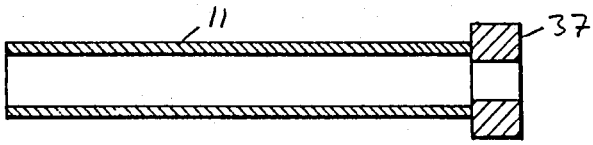
FIG. 19 shows a longitudinal section of a stabilizer with a shoulder for supporting a plate.

In FIG. 19, an alternative to the flange 12 is shown. A cylinder 37 is friction welded to the tube 11 in order to form a support for the rock engaging plate 13.

I claim:

1. A method of stabilizing a rock structure, comprising:

boring a borehole in said rock structure;

inserting a tubular stabilizer into said borehole such that at least a portion of said tubular stabilizer protrudes from said borehole, said tubular stabilizer being made of mild steel and having a substantially circular cross-section which is slimmer than the cross-section of said borehole;

pressurizing an expandable body inside said tubular stabilizer while said tubular stabilizer is in said borehole, by applying a pressure fluid to the interior of said expandable body, to thereby expand said expandable body within said tubular stabilizer past the inner original perimeter limits of said tubular stabilizer over a substantial portion of the length of said tubular stabilizer so that said tubular stabilizer is widened radially over a substantial portion of its length to fill irregularities of said borehole and is caused to elastically widen the rock around said tubular stabilizer; and then depressurizing said expandable body to reduce the diameter of said expandable body so as to release said expandable body from said tubular stabilizer, and then removing said expandable body from said tubular stabilizer which is left anchored in said borehole by a shrinkage fit between the rock and said tubular stabilizer when said rock shrinks after depressurization of said expandable body.

2. The method of claim 1, wherein said tubular stabilizer is first mounted on said expandable body and then inserted in said borehole.

3. The method of claim 2, wherein said tubular stabilizer is expanded to anchor in said borehole over substantially the entire length of said tubular stabilizer.

4. The method of claim 1, wherein said tubular stabilizer is expanded to anchor in said borehole over substantially the entire length of said tubular stabilizer.

5. The method of claim 1, wherein said tubular stabilizer is provided with a closed cross-section.

6. The method of claim 1, wherein said tubular stabilizer is provided with an axial slot and said tubular stabilizer is widened in the vicinity of said axial slot substantially without its periphery being extended.

7. The method of claim 6, wherein said tubular stabilizer has overlapping edges at the portions thereof at which said axial slot is formed.

8. The method of claim 3, wherein said tubular stabilizer is provided with an axial slot and the said tubular stabilizer is widened in the vicinity of said axial slot substantially without its periphery being extended.

9. The method of claim 8, wherein said tubular stabilizer has overlapping edges at the portions thereof at which said axial slot is formed.

10. The method of claim 3, wherein said tubular stabilizer is provided with a closed cross-section.

11. The method of claim 1, wherein said pressurizing step comprises actuating a valve means to permit pressure fluid to flow to the interior of said expandable body to expand said expandable body within said tubular stabilizer.

12. The method of claim 11, wherein said expandable body is an elongated tubular expandable member.

13. The method of claim 12, wherein said expandable member is made of reinforced rubber.

14. The method of claim 1, wherein said expandable member is made of reinforced rubber.

15. The method of claim 1, wherein said expandable body is an elongated tubular expandable member.

16. The method of claim 15, wherein said expandable member is made of reinforced rubber.

17. The method of claim 1, comprising pressurizing said expandable body to between 50 and 100 MPa.

18. The method of claim 12, comprising pressurizing said expandable body to between 50 and 100 MPa.

* * * * *